United States Patent [19]

Willimczik

[11] Patent Number: 4,548,559

[45] Date of Patent: Oct. 22, 1985

[54] ROTARY UNIT

[76] Inventor: Wolfhart Willimczik, Schloss-Strasse 60, D-8037 Olching/Esting, Fed. Rep. of Germany

[21] Appl. No.: 650,302

[22] Filed: Sep. 12, 1984

Related U.S. Application Data

[63] Continuation-in-part of Ser. No. 521,221, Sep. 10, 1983, abandoned, which is a continuation of Ser. No. 201,523, Oct. 28, 1980, abandoned.

[30] Foreign Application Priority Data

Nov. 16, 1979 [DE] Fed. Rep. of Germany ..... 2946304

[51] Int. Cl.[4] ..... F01C 3/04; F01C 19/10

[52] U.S. Cl. ..... 418/136; 418/195

[58] Field of Search ..... 418/136, 137, 192, 193, 418/195, 209, 228–231

[56] References Cited

U.S. PATENT DOCUMENTS

| | | | |
|---|---|---|---|
| 167,146 | 8/1875 | Winkler | 418/229 |
| 173,030 | 2/1876 | Lucas | 418/229 |
| 764,551 | 7/1904 | Bot | 418/229 |
| 2,101,051 | 12/1937 | Cuny | 418/195 |
| 2,232,599 | 2/1941 | Fehn | 418/230 |
| 2,242,058 | 5/1941 | Cuny | 418/195 |
| 3,034,445 | 5/1962 | Pelladeau | 418/229 |
| 3,622,255 | 11/1971 | Lusztig | 418/195 |

FOREIGN PATENT DOCUMENTS

| | | | |
|---|---|---|---|
| 581950 | 9/1958 | Italy | 418/229 |
| 267509 | 4/1928 | United Kingdom | 418/228 |

*Primary Examiner*—John J. Vrablik
*Assistant Examiner*—Jane E. Obee
*Attorney, Agent, or Firm*—Balogh, Osann, Kramer, Dvorak, Genova & Traub

[57] ABSTRACT

A rotary piston displacing machine for use as a pump compressor or power engine, as well as a hydrostatic coupling. The machine has a disk-shaped rotor rotatable in a housing, several similar diametrically opposed rotary vanes which penetrate the annular groove of the working space, which vanes can be joined or formed together in a second rigid rotor, the impeller, the disk-shaped rotor having a rotational axis forming an acute angle with the axis of the impeller. The disk-shaped rotor is positioned obliquely on the working space and is provided with radial slots for receiving the vanes which reach down to the bottom of the working space to sealingly lock the adjacent working chambers formed in the working space. The displacement operation takes place by the rotation of the vanes and the changing cross-section of the groove of the working space. If the cross-section of the working space approaches zero on one point of its periphery, i.e., when the disk-shaped rotor touches this point at the bottom of the working space, this displacing machine has neither a dead space volume nor squeezing points. It is sufficient if only one vane locks sealingly the adjacent chambers of the working space within the area of greatest cross-section since a stationary separating point exists already there. The shape of the cross-section of the working space, the shape and number of the vanes, and the shape of the rotors can be selected freely within a wide range. However, a certain symmetry of the rotation must be maintained, and the parts must be naturally adapted one to another. This rotary piston machine is suitable for use as a machine for displacing all kinds of freely flowing media, as well as for use as a power engine in the form of a displacer turbine.

12 Claims, 13 Drawing Figures

Fig.5
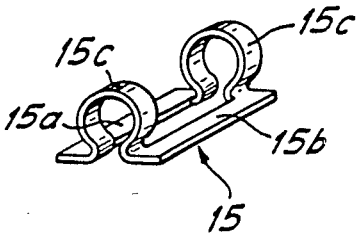
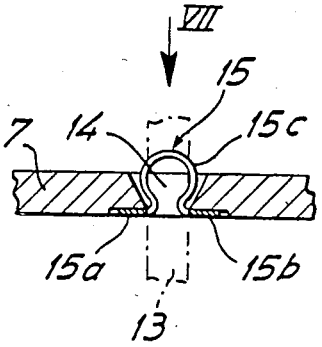
Fig.6
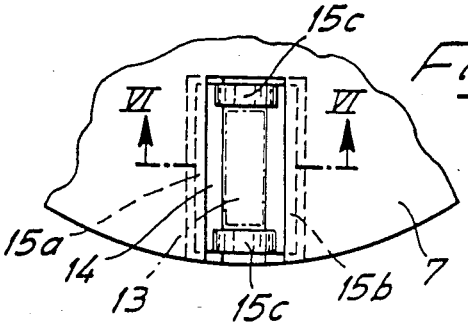
Fig.7
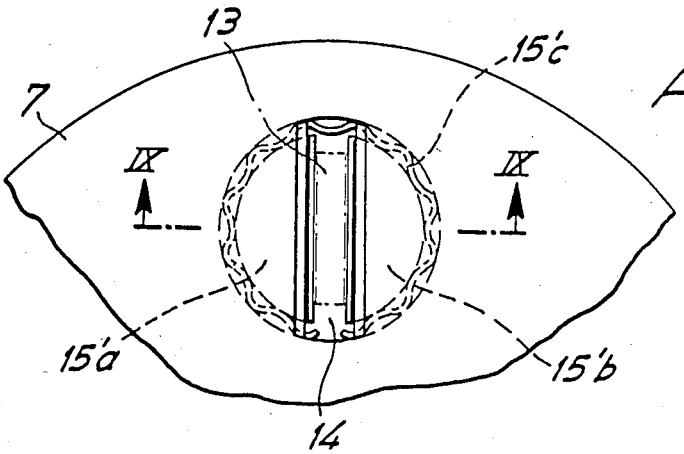
Fig.8
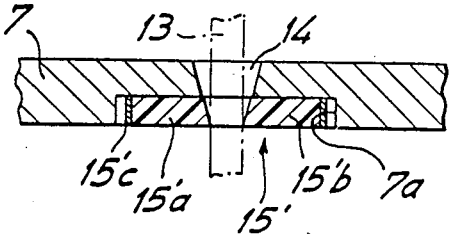
Fig.9

14a
3
7
5
6
13
13c
14a
13c
4
4a
2
13
XI
XI
15
8
1
11
11'
18
12'b
12'a
12b
12a 16
1
15
17
17a
13c
12b
X
X
13
12'b
7
13
14a
13c
12'a
12a

ROTARY UNIT

This application is a continuation-in-part of application Ser. No. 521,221, filed Sept. 10, 1983, now abandoned, which was a continuation of application Ser. No. 201,523, filed Oct. 28, 1980, now abandoned.

FIELD OF THE INVENTION

The invention relates generally to a rotary assembly unit, and in particular to a rotary piston displacing machine with the axes of interengaging vanes and rotor forming an acute angle therebetween, for use as a pump, compressor or processing machine with varying capacity for flowing media.

BACKGROUND OF THE INVENTION

A number of similar designs for rotary piston machines have been known and suggested for use in the pertaining art. However, these designs could not be widely used because of various difficulties and deficiencies in their construction and function.

These conventional designs were based on a complicated geometrical relationship of two bevelled intermeshing rotors and included certain spots or points (blow-through holes) that remained open, and crushing or squeezing points were formed with large dead spaces (or clearance volumes).

The use of these designs created some sealing problems that could not be simply solved, but only through a complicated construction and shape, e.g., by spherical walls.

There has been a long-felt need and demand for a design and construction of a machine that can be completely and simply sealed, but no one came up with such design.

Thus, for example, in conventional designs, there has been the problem that the rigid vanes or blades can fit exactly or precisely into the rotor slots, only at certain determined angles of rotation (the projection of a straight angle changes already when its plane is differently inclined, just as the inclination between the vanes and the disk-shaped rotor changes constantly for an observer that rotates along them), and cannot be led exactly in any desired arrangement of the rigid vanes in the rigid rotor slots. No simple solution has been found to such a problem.

In the case where more than two diametrical vanes or blades are involved, the situation becomes even more complicated (only in the case of two diametrical, mathematically thin vanes or blades could the plane of the disk-shaped rotor be tipped in any desired direction).

As observed, a rotating vane or blade moves in the diagonal plane of the disk-shaped rotor, although it is rigidly attached onto the impeller (vane rotor) and moves at one point of rotor periphery somewhat faster and at another point somewhat slower than the pertinent rotor slot, i.e., a 90° distance between two vanes or blades changes in the plane of the disk-shaped rotor according to the position to 89° or 91°. This distance must be between the rotor slots, and these must thus be shiftable.

These variations must be compensated in case that the displacing machine has to remain tightly sealed, i.e., either the vanes or blades must be elastically and rotatably placed (starting with the third vane or blade, or at least some of them) so that their angle may change during each rotation, or the rotor slots must be elastically-shiftably placed and be rather shiftable to some extent in the peripheral direction. The disk-shaped rotor itself can also be slightly elastic altogether. It can be elastic mostly for the purpose of compensating for the widening of the slots by tipping the vanes or blades. This effect, however, is smaller by an entire order of magnitude and thus equally less significant than the first.

Not considering the first effect of the relative shiftings of the vanes or blades relative to the rotor slots makes the entire displacing machine completely inoperative.

SUMMARY OF THE INVENTION

It is the task of the present invention to solve these problems.

It is the main objective of the invention to design a displacing machine of the mentioned rotary piston type which has such tightly sealed working chambers that they could compete even with the reciprocating piston system. This machine should be easy to produce and should have a broad range of applicability that encompasses pumps, compressors, compressed air-hot gas motors, volume meters with hydrostatic clutch or retarder to "displacement" (pumping) turbines.

The set task is solved according to the invention by the following combination of features:

The working space is formed as an annular groove (in the housing of the machine) covered toward the inside and outside by the disk-shaped rotor; the axial vanes which are connected to the impeller are disposed in the working space in a slidingly sealing manner along the walls of the working space so that the outer diameter of the disk-shaped rotor is greater than the outer diameter of the impeller, the radial slots of the disk rotor being longer in radial extent (or dilation) towards the inside and outside than the axial vanes, and the radial slots having a V-shaped cross-section such that their bevelled or oblique walls are inclined relative to the center surface, at least as much as the axes of the impeller (and/or vanes) and disk-shaped rotor are inclined to one another, respectively; the narrowest points of each of the radial slots lie in the contacting surface between the disk-shaped rotor and the housing; the point of intersection S of both the axes of the impeller (and/or vanes) and the disk-shaped rotor lie in the contacting surface between the disk-shaped rotor and the housing; the axial vanes are arranged (or formed to be slightly elastically rotatable in the peripheral direction, so that they can move elastically or slidingly in their respective radial slots.

The task is not solved by securing the impermeability additionally by means of correspondingly many, highly mobile sealing portions. Elastic vanes are actually not considered, at least not for higher pressures, since the wear of the slots proves then to be too great. A construction is rather selected in which the entire shiftings of the sealing lines are minimized by the bevelling of the axes of rotation.

An exact computation of the totality of parameters effecting the changes of the widths of slots during one rotation brought along the following results:

The angle changes between the vanes in the bevelled disk plane have per rotation two maxima and two minima. The extreme values depend again in the other parameters and can thus be minimized, i.e., their amplitudes can be made small. These parameters are the bevelled angle, the diameter and the form of the annular groove, the position of the axes of rotation, but equally the number, position and form of the vanes.

First of all, the working space is made as an annular groove (recess) placed in a lateral portion of the housing, the diameter of which is great in comparison to the width of the groove (recess) (which enables the keeping of the bevelled angle small). The working space is completely covered by a rotating-along, disk-shaped rotor, the diameter of which is greater than the diameter of the impeller or vane rotor and the edges of the annular groove are also sealed off.

This brings a substantial advantage: the cross-sectional shape of the annular groove is now completely independent of the shape of the disk rotor and the type of its sealing effect. Both parts can now take on, independently of one another, any desired but only rotationally symmetrical shape, i.e., can be adapted to the actual displacement (pumping) problem.

Due to the occurring bevelled position of the vanes in the slots, these must be designed to be of a V-shape and slightly longer than the vanes in radial dilation or extent (toward the inside and outside thereof), and the narrowest point must lie in the contacting or supporting surface between the housing and the disk-shaped rotor, so that no blow holes can be created radially outside and inside thereof.

The edges of the vanes, of the slots and of the radial recess (groove) converge thus precisely into one point.

In order to prevent problems encountered in conventional designs and to ensure that the vanes do not jam in case of certain angles of rotation, or in case of two vanes lying in one radial plane, or in case that more than one pair of vanes has a minimum of shiftings, the point of intersection of the axes of rotation of both rotors must lie in the contacting plane of the vanes between the housing and the disk rotor, respectively, in the contacting plane of the vanes and of the V-shaped slots.

Since the working space, particularly the annular groove, can be formed into any desired shape in its cross-section, it can be restricted, for example, by simple cylindrical walls so that the bottom can be designed of a conical shell, even, or of any other shape. The cross-section of the working space can be equally tapered downward so that the cut-to-fit vanes may be accordingly naturally adjusted (this can also be made automatically, for example, by means of a spring).

In practice, an approximately round-shaped form of the vanes, particularly of the cross-section, has proven to provide a good sealing.

The annular groove is always cut in such a bevelled manner that it completely disappears when the dead volume in the working space must disappear, particularly when the disk rotor fills out the entire cross-section of the groove (recess) and is adjacent to the bottom of the groove, the surface of the bottom of the groove can pass over into the surface of the disk rotor, i.e., the bottom of the groove is designed here in such a shape of a conical shell (in the case of a flat or even disk rotor) that it is adjacent to a line of the shell and particularly proceeds tightly along it.

The tip of the completed cone would come to lie in the point of intersection of both axes of rotation, but also the disk rotor can equally be of the shape of a conical shell, and the bottom of the groove can be flat for it, or be of another shape. The described peripheral point may be most often applied as a point of separation between the suction and the pressure space. It is then possible to use corresponding recesses in the bottom of the annular space in front or respectively behind this point of separation as an outlet or respectively an inlet.

The outlet can be made here so large that no cross-sectional reduction occurs after the range of displacement (pumping or compression) is proper (for example, 90° in the case of four vanes), and that no more squeezing points can exist any more. The inlet can be made also as wide as the annular groove (recess). The vanes slip on as a knife's edge at the end of the inlet channel, which may serve for the comminution of the passed-along solids.

The number of the mobile parts must not increase for multi-step machines. Several annular spaces can be arranged concentrically one into the other, and the vanes can remain also rigidly interconnected.

The best and simplest sealing is obtained with only one pair of vanes where both vanes are placed within the same radial plane. No shiftings of the slots in the peripheral direction, particularly a torsion of the pair of vanes between themselves, are necessary. Only about a 10-times smaller widening of the slots by bevelling the vanes, remains necessary as long as the vanes remain flat for the sake of simplicity. This widening may amount practically to only a few hundredths of a millimeter, which may be corrected without using special sealing devices (for example, by means of having the disk-shaped rotor consisting of two half disks which are held together by an appropriate device, particularly the material within the area of a few hundredths of a millimeter is elastic).

The housing space placed opposite the working space above the disk rotor is filled with the pumped or displaced means. In case that the leakage losses on the suction and on the pressure side remain approximately equal, approximately half of the displacement pressure is formed here, and the leakage on the disk rotor must overcome only half of the overpressure before it has reached the suction side. A displacement occurs, however, already when the suction side only is sealed, i.e., when the disk rotor is loosely adjacent or is elastic, it is lifted on the pressure side and acts simultaneously as an outlet (discharge) valve. The outlet in the annular groove can be kept there and placed upside into the housing, since the space above the disk rotor fills up at full overpressure.

Sometimes it becomes desirable in the case of displacing liquids, to use more than two vanes in order to reduce, for example, the pulsation, or to increase the inlet opening or some other things, but already with three vanes, two of them do not fit with every angle of rotation due to the described changes of angles into the rigid slot. Either the vanes must be made more elastic or elastically-rotatable or mobile (in the peripheral direction of the impeller) in this case, or the slots must be rendered movable or elastically slidable with the help of a slot mask in the peripheral direction while the vanes can compensate elastically for the widening of the slots. Two different ways can now be selected: either the shiftings are collectively and uniformly distributed for all the slots, and then only by elastic parts, or a diametrical pair of vanes is fastened with the respective slots (this is the exceptional case in which the changes of angles occur), and all others are made shiftable.

This system is characterized especially by its high variability. This is why all variants could not have been realized. This system could thus be suitable not only as a pump, a compressor or a power engine, but also as a hydrostatic coupling where the creation of an oil cone in the closed displacement chamber will transfer a torque from the rigid vanes upon the then rotating-along housing. By means of an axial shifting of the vanes, it is possible to couple in or out. Such a coupling (clutch) could be integrated with transmissions which are already available in automotive vehicles. Should the oil be connected besides to a cooling circuit, this design is suitable for the disposal of the braking energy as a retarder, particularly as a "hydraulic brake". A prevention of blocking would be automatically provided there.

It is also possible to strongly vary the shape of this displacement (pumping or compression) machine, thus, for example, the inner wall of the working space can be entirely omitted, the annular groove (recess) can be milled so far obliquely that it is even shorter than the point of separation, i.e., shorter than 180° in the peripheral direction, having then the vanes totally driven out on the point of separation from the slots (which, however, does not cause any leakage).

It is also possible to place a working space above the disk rotor, which makes in any case the sealing problem more difficult.

A great advantage of this displacement machine in comparison with others equally equipped with mass power-free flow turbines, is that the "displacement turbine" can work economically already with lesser pressure conditions or smaller outputs, i.e., it can be coupled after the outlet (discharge) side of a flow turbine, in order to exploit also the available energy.

This system can be equally applied as an exhaust gas turboloader or better even as a power engine, where a continuous combustion or another working process with closed or open circuits can be realized, and with outputs below 100 KW, it is still possible to obtain good efficiencies.

BRIEF DESCRIPTION OF THE DRAWINGS

The invention is further explained and illustrated in the following drawings and examples of embodiments:

FIG. 5 is a perspective lateral view of a sealing destined to be built into the rotor of the rotary aggregate.

FIG. 6 is a cross-sectional view of the same sealing in its built-in state, along the line VI—VI of FIG. 7.

FIG. 7 is a top view of the built-in sealing in the direction of the arrow VII of FIG. 6.

FIG. 8 is a top view corresponding to FIG. 7 of another form of embodiment of the built-in sealing.

FIG. 9 is a cross-sectional view of the same built-in sealing along the line IX—IX of FIG. 8.

Figure 1:
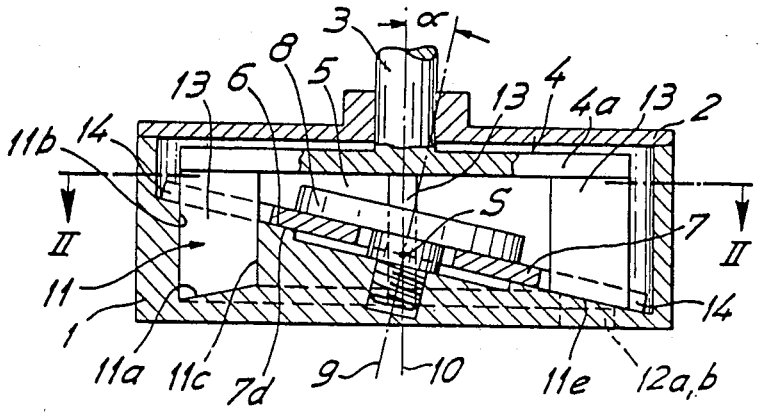
FIG. 1 is a schematically illustrated axially-sectional view of a rotation aggregate designed as a displacement machine.
Figure 2:
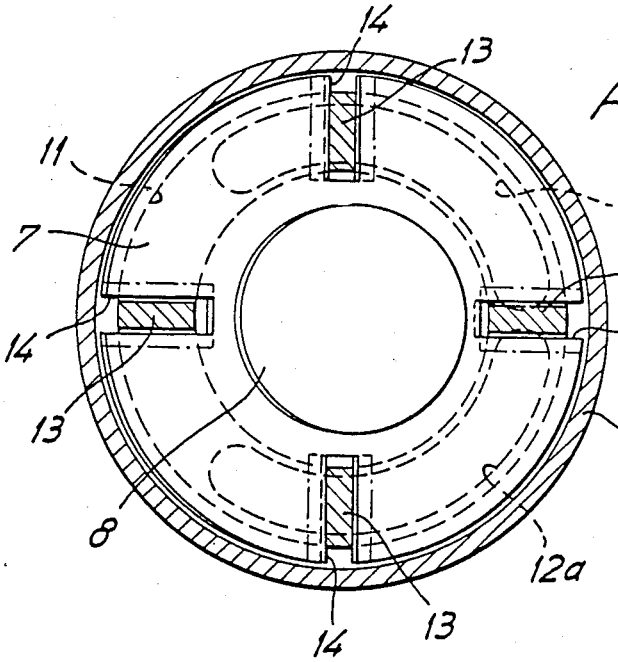
FIG. 2 is a cross-sectional view of the displacement machine according to FIG. 1 in a cross-section along the line II—II of FIG. 1.

The rotation aggregate represented in FIGS. 1 and 2 as a displacing machine designed for a different application consists of an about pot-shaped housing 1, the cover 2 of which is crossed axially by a driveshaft 3 of an impeller 4 rotatingly supported in the housing 1.

The housing 1 receives the impeller (impeller wheel) 4 at the top in a free space that is downwardly limited by a contacting or supporting surface 6 proceeding obliquely (in a visible manner) for an annularly or disk-shaped rotor 7 which is rotatable by means of a set screw 8 disposed vertically to the supporting surface 6. The rotor 7 rotates and proceeds around axis 9 forming with the axis of rotation 10 of the impeller wheel 4, an acute angle $\alpha$.

The bottom portion of the housing 1 formed underneath the supporting surface 6 is provided with a ring-shaped or annular working space 11 that is concentric with the axis of rotation 10, and having a bottom or floor 11*a* conically tapered or of the shape of a conical shell. As shown, the tip of the conical shell containing the bottom 11*a* coincides with the point of intersection S between the axis 9 and the axis of rotation 10. Finally, the working space 11 is designed in a cylindrical shape and has two side walls 11*b* and 11*c* (inner and outer walls) cylindrically concentric to the axis of rotation 10. Besides, FIG. 1 shows that the depth of the annular working space 11 that reaches a maximal value on the left side of the housing 1, decreases due to the oblique path of the supporting surface 6, on the right side of the housing, to the value of zero, so that the working space 11 is interrupted on this appropriately slightly flattened point of interruption 11*e* by the rotor 7 directly adjacent to the bottom 11*a*. Connected with the point of interruption 11*e* in the bottom 11*a* of the working space 11 at both sides is per one inlet and outlet channel or port 12*a* or respectively 12*b* of a shape of an annular section that pervades downward at the bottom of the housing 1.

As seen further in FIGS. 1 and 2, the impeller wheel 4 connected with the driveshaft 3 consists of a base unit 4*a* of the shape of a circular disk from which four vanes 13 depart along a concentric circle, proceeding above the annular working space 11, always within a radial plane downward into the working space 11 and always through a radial slot 14 of the rotor 7 corresponding to the width of the vane. The vanes 13 are otherwise adapted to the radial cross-sectional profile of the working space 11 and placed therein in a slidingly sealing manner along the walls, so that they are adjacent to its bottom 11*a* and its side walls 11*b* and 11*c* with a basically slight interspace or clearance (play) that allows the frictionless (or sliding) rotation of the impeller wheel 4 in the working space 11.

By means of driving the impeller wheel 4 by the driveshaft 3, the vanes 13 slide according to FIG. 2, for example, clockwise starting from the point of interruption 11*e* to the inlet channel 12*a* and form thus behind themselves, in the direction of rotation, each one, an increasingly growing suction space into which the liquid to be displaced is sucked-in into the inlet channel. The liquid to be displaced is correspondingly displaced further from the pressure space placed opposite the inlet channel and reduced in size, in the direction of rotation of the vane 13 into the outlet channel 12*b*.

Figure 3:
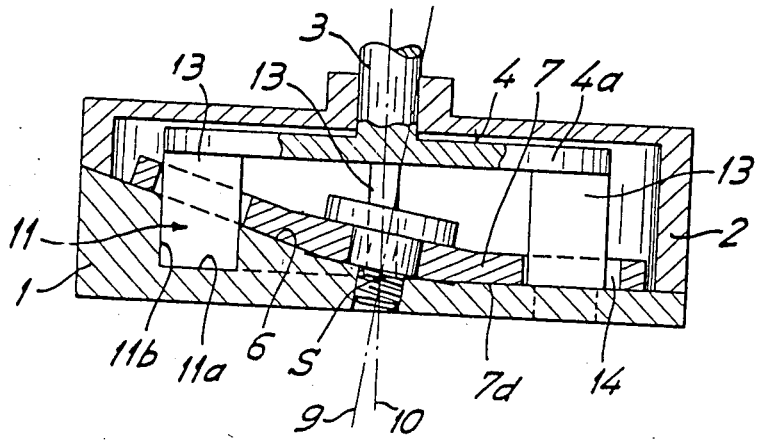
FIG. 3 is an axial cross-sectional view of a displacement machine slightly altered in comparison with the one in FIGS. 1 and 2, in an axial cross-section, according to FIG. 1.

As represented in FIG. 3, the working space 11 can have equally, a flat bottom 11*a*, in which case, however, the supporting surface 6 is inclined toward the point of intersection S and concentrically to the axis 9 of the rotor 7 so conically that, in the radial plane shown in FIG. 3 at the right side, the displacing machine proceeds in the local radial direction of the supporting surface 6 simultaneously within the plane of the working space bottom 11*a*. The lower side face 7*d* of the rotor 7 forming the second front wall of the working space 11, facing the supporting surface 6, must then naturally be also formed in a corresponding conical shape. Finally, lower front faces result thus also for the vanes 13 in a mutual oblique plane to the axis of rotation 10 which slides along the bottom 11*a* during the operation of the displacing machine.

FIG. 1 shows further that the vanes 13 pervade always in their position, being placed obliquely to the plane of projection of the slots 14. It is advantageous when the slots 14 have additionally a V-shaped cross-section. In order that, in spite of this, no leakage losses appear as far as possible at the location of the slots 14, it is possible to foresee at the location of each slot 14, a sealing 15 shown in FIGS. 5 to 7, consisting of two rectangular plates 15*a* and 15*b*, proceeding in parallel to one another, interconnected, being elastically spring-actuated by means of semi-circularly arched bow portions 15*c* in a distance corresponding on their both ends to the radial width of the vanes one from another (in the sense of pressing one against another), the facing of each of the plate edges to the side faces or surfaces of the vanes 13 pervading or occupying the sealing 15. According to FIGS. 8 and 9, the sealings 15' can, however, consist also of two about semi-circular plates 15'*a* and 15'*b*, which are pressed against the vane 13 pervading or occupying its diametrical gap by a radially sprung ring 15'*c*, arranged along its common circular periphery. An adapted for it recess 7*a* serves then for the reception of the sealing 15' at the place of each radial slot 14, appropriately on the side turned toward the working space 11 of the rotor 7.

The inclination of the supporting surface 6 of the radial inclination of the bottom 11 does otherwise not need to be adapted in the manner that is visible in FIG. 1. A certain conical shape of the bottom 11*a* is then naturally not relevant at all, and it can be designed equally flat.

Figure 4:
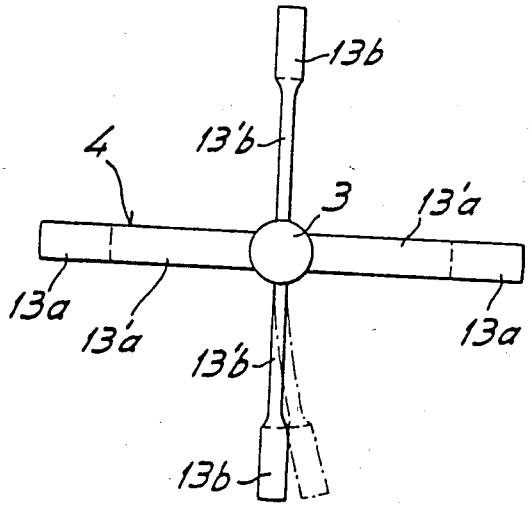
FIG. 4 is a top view of an altered wing wheel for the displacement machine according to FIG. 3.

The impeller wheel 4 needs, in the simplest case, basically two diametrically opposite vanes 13 which are then rigidly connected with the driveshaft 3. Four vanes produce, namely, a slightly greater displacing (pumping or compressing) current (and practically a current free of pulsations), but they cannot follow precisely while they rotate the slots 14 of the rotor 7. As far as the acute angle between the axis 9 of the rotor 7 and the axis of rotation 10 of the driveshaft 3, such angle should not be selected very small. It is advantageous when, beside the sealings 15 or respectively 15', special measures are applied also to the impeller wheel 4, which permit to have a greater play in the location of the slot 14. In the embodiment of the example illustrated in FIG. 4, the impeller wheel 4 is provided for this purpose with two diametrically oppositely placed vanes 13*a* connected by spikes 13'*a* formed rigidly with the driveshaft 3, while further, two equally oppositely placed vanes 13*b* are connected with the driveshaft 3 by a thinner, elastically spring-actuated spike 13'*b*. The transfer of the driving to the rotor 7 is then made mainly by the vane 13*a*, while the vane 13*b* can yield to only very slight dislocations of the assigned slot 14 from the cruciform of the impeller wheel 4. As indicated in FIG. 4, the exagerated dashed line shows the inclined position of rotor 7 during operation. In reality, merely a dislocation of only about 1° occurs in the size of the acute angle illustrated in FIG. 1 and between the corresponding inclination of the rotor 7.

Figure 10:
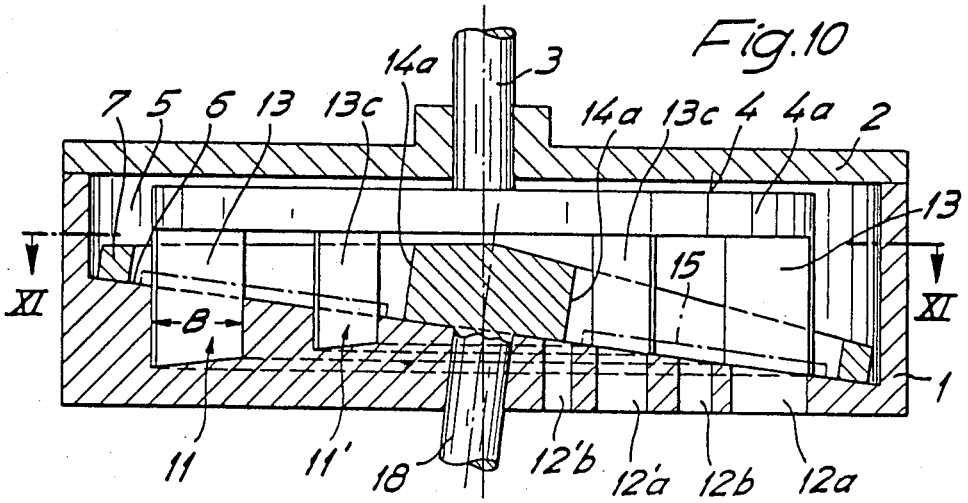
FIG. 10 is an axial sectional view of a further form of embodiment of a displacing machine, along the line X—X of FIG. 11.
Figure 11:
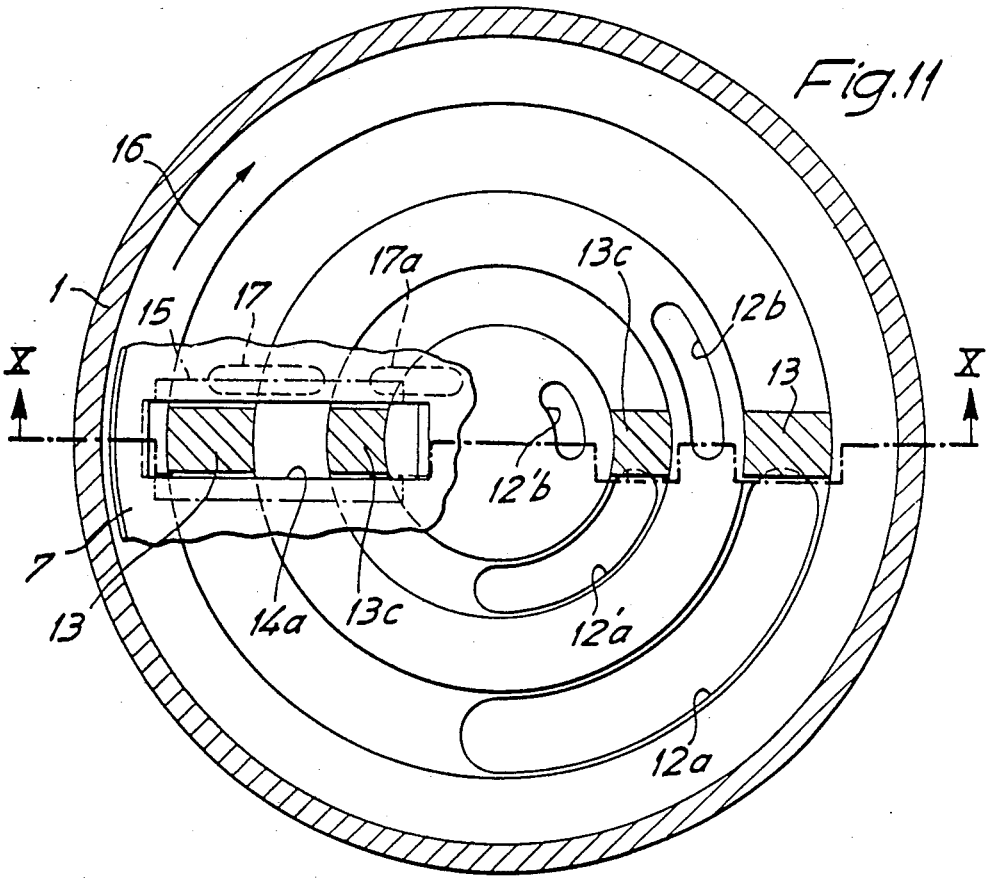
FIG. 11 is a cross-sectional view of the displacing machine according to FIG. 10, along the line XI—XI of FIG. 10 (the rotor of the displacing machine is only partly illustrated for a better visibility of the details).

FIGS. 10 and 11 illustrate a displacing machine that has been modified in comparison with the first example of an embodiment insofar as described below. Instead of only one annular working space, two concentric (to one another) working spaces 11 and 11' are provided from which the outer space 11 has a greater radial width B than the inner space 11'. Accordingly, the impeller wheel 4 has, in addition to the vanes 13 which are arranged along an outer concentric circle, also further vanes 13*c*, arranged along a smaller concentric circle, which by the nature of their position and profile, fill up (in a manner that has already been explained in connection with the first example of an embodiment) the radial cross-sectional profile of the associated (assigned to them) respective working spaces 11 and 11*a*. The radial slots 14*a* are also designed so long that each slot 14*a* can receive now two vanes, namely, one each of vanes 13 and 13*c*. Furthermore, this results naturally in that the sealings 15, provided along the side edge of the slots 14*a*, must be adapted to the length of the slots in the manner indicated by dot-dash lines in FIGS. 10 and 11. While the inlet channels 12*a* and 12'*a* in the housing 1 assigned or associated to both working spaces 11 and 11' are arranged in the same manner as in the first example of an embodiment, always underneath the assigned or associated working space 11 or respectively 11', the equally circular arc-shaped outlet channels 12*b* and 12'*b* proceed in the housing 1, according to FIG. 11, always radially inward of the assigned or associated working spaces 11 and 11', with a circumferential or peripheral length that is substantially reduced in comparison with the inlet channels 12*a* and 12'*a*. In order that the displaced or delivered medium may arrive from the working spaces 11 and 11' into the assigned or associated outlets or discharge channels (ports) 12*b* and 12'*b*, the rotor 7 is provided with a groove 17 or respectively 17*a* per working space, leading radially inward from the same generating space and indicated in dashed lines in FIG. 11. The groove 17 or respectively 17*a*, is shown in the direction of rotation of the rotor 7 by an arrow 16 on its side facing the supporting surface 6 where the groove 17 reaches up over the circle showing the outlet or discharge channel 12*b* and the groove 17 projects up to above the outlet (discharge) channel receiving circle in the bottom of the housing 1. Since there is thus a connection that is made possible between the space portion (subspaces) of both working spaces 11 and 11' (located in front of the vanes 13 and 13*c* toward their associated outlet channels 12*b* and 12'*b*), only after a considerable reduction of volume of these space portions, this channel arrangement presumes a design of the displacing machine according to FIGS. 10 and 11 as a compressor (or in the case of a reversed direction of rotation, as a power engine). When a volume increase occurs in the locked-out space portions of the working spaces 11 and 11' of the discharge channels 12*b* and 12'*b*, which work now as inlet channels, a volume increase is formed, for example, by the combustion of a mixture that leads to a driving of the vanes 13 and 13*c* against the direction of the arrow 16. In order to prevent an excessive axial load of the slots 14 by the more or less equal drive of the rotor 7, it may then be considered to have the rotor 7 provided with a shaft 18, projecting from the housing 1, to be driven mechanically according to FIG. 10 by the drive of the working (processing) machine rotating in the same manner as the impeller wheel 4.

Figure 12:
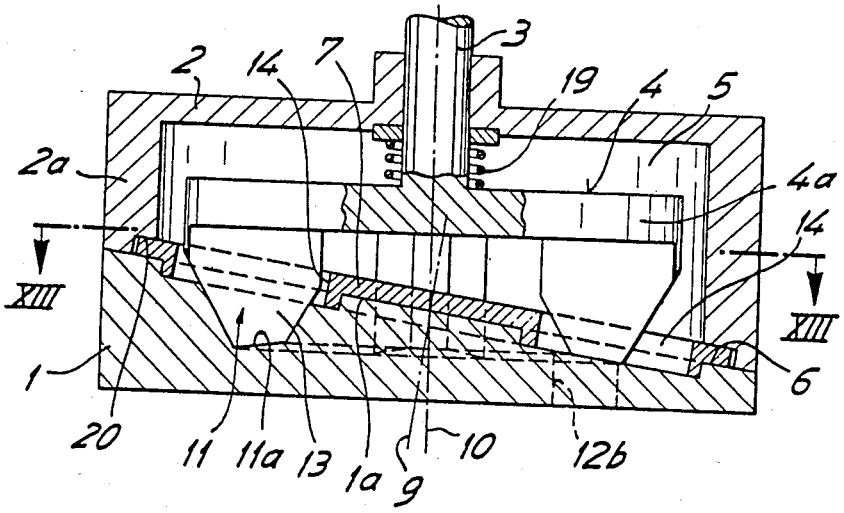
FIG. 12 is a sectional view of a further form of embodiment of the displacing machine corresponding to FIG. 1.
Figure 13:
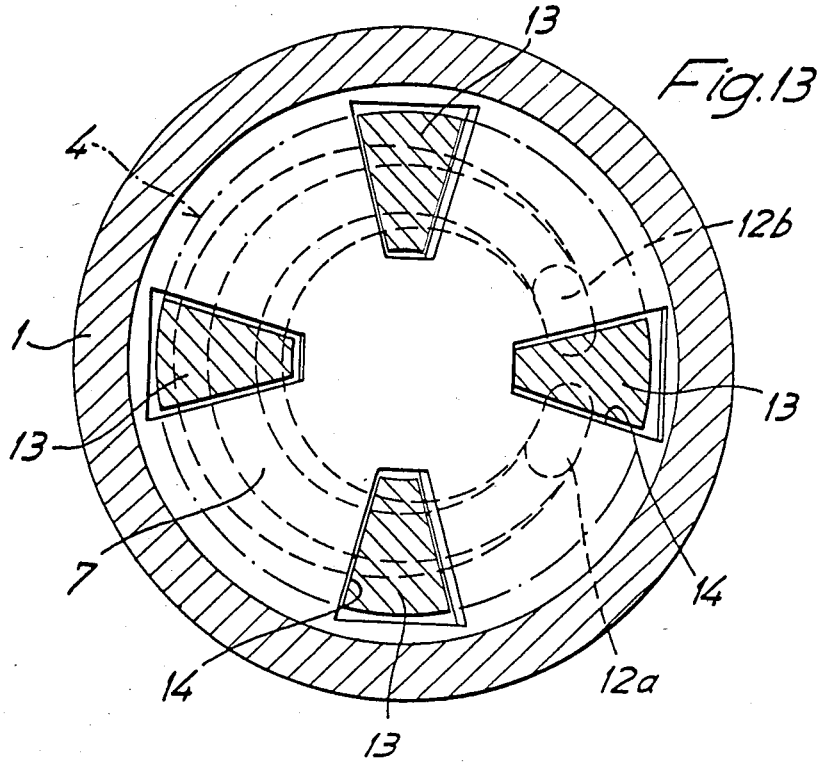
FIG. 13 is a cross-sectional view of the displacing machine according to FIG. 12, along the line XIII—XIII of FIG. 12.

FIGS. 12 and 13 show another embodiment of a displacing machine. It differs from the displacer according to the first example of an embodiment mainly by that the vanes 13 have an approximately trapezoidal cross-section with a correspondingly large sealing surface compared with the bottom 11*a* of the working space 11, and that the working space 11 is tapered in its radial cross-section toward its bottom 11*a* in a V-shaped form. The above-mentioned vanes 13 are naturally correspondingly tapered in a V-shape toward their free ends. Such or similar tapering of the working space 11 and of the vanes 13 makes it possible to compensate in a simple manner the sealing supporting surfaces of the vanes 13 for the unavoidable wear and tear to which they are subjected by means of a simple axial readjustment of the impeller wheel 4 toward the working space 11. This readjustment can be effected, for example, by a helical or worm spring 19 surrounding the driveshaft 3, on the one hand, on the base unit 4*a* of the impeller wheel and, on the other hand, on the cover 2 of the housing 1. This results not only in a very simple, but also in a very robust, reliable and safely operated displacing machine that is equally applicable with appropriate changes as a pump for abrasive media or similar.

The helical spring 19, illustrated in FIG. 12, can in certain circumstances be omitted when the space in the housing 1, located above the rotor 7, is actuated by the displacing medium that flows under pressure. Since a component of the compressive force on the impeller 4 moves in the direction of the working space 11, an automatic readjustment of the impeller wheel 4 is produced in this manner. The cover 2 with a cylindrical shoulder (or attachment) 2*a* reaches in this example of an embodiment, up to the supporting surface 6 of the housing 1 and receives the outer edge of the rotor 7 in an annular groove 20 that prevents the rotor from lifting from the supporting surface 6. It needs, therefore, no further axial guiding of the rotor 7 which, due to reasons of its production, is still guided centrally only on an axial pivot 1*a* of the housing 1.

What is claimed is:

1. In a rotary piston machine for use in pumps, compressors, and processing machines with varying capacity for flowing media, which rotary piston machine comprises a housing having walls forming a working space therein, a drive shaft outwardly penetrating the housing, an impeller mounted in the housing and connected to said drive shaft, said impeller having axial vanes that penetrate the working space of the housing, a disk-shaped rotor is rotatably arranged in the housing, and provided with radial slots for receiving therein the axial vanes of said impeller, and a contacting surface is disposed on the bottom of the housing for supporting the disk-shaped rotor therein, the axial vanes penetrating the disk-shaped rotor through the radial slots thereof and projecting there-through into the working space, the vanes being rotatable about an axis forming an acute angle with the rotational axis of the disk-shaped rotor, and vanes being disposed in the working space in a slidingly sealing manner along the walls of the working space so that the outer diameter of the disk-shaped rotor is greater than the outer diameter of a said impeller, the improvement which comprises the working space formed as an annular groove in an axial housing wall, which is radially covered toward the inside and the outside thereof by the disk-shaped rotor, the radial slots of the disk-shaped rotor being longer than the axial vanes in radial dilation or extent towards the inside and outside thereof, and having a V-shaped cross-section such that their bevelled or oblique walls are inclined relative to their center surface at least as much as the axes of the vanes and the disk-shaped rotor are inclined to one another, respectively, the narrowest points of each of the radial slots lying in said contacting surface between the disk-shaped rotor and the housing, the point of intersection S of both the axes of the vanes and the disk-shaped rotor lying in said contacting surface between the disk-shaped rotor and the housing, and at lease some of the axial vanes being arranged slightly elastically rotatably in the peripheral direction of said impeller.

2. An improved rotary piston machine according to claim 1, in which the radial slots are arranged collectively in the disk-shaped rotor in an elastically slidingly manner in the peripheral direction thereof.

3. An improved rotary piston machine according to claim 1, in which the axial vanes start from the body of said impeller, and are divided along concentric circles thereon, each of the vanes penetrating the rotor through a respective one of the radial slots and projecting into an angular working space.

4. An improved rotary piston machine according to claim 1, in which said impeller has two diametrically opposite axial vanes.

5. An improved rotary piston machine according to claim 1, in which at least some of the radial slots of the disk-shaped rotor are sealed off by means of pressed-on mobile seals.

6. An improved rotary piston machine according to claim 1, in which the bottom of the working space is flat or straight, and disk-shaped rotor is conical and forms a contacting line with the bottom of the working space at a peripheral point forming the point of contact between the rotor and the bottom of the working space.

7. An improved rotary piston machine according to claim 6, further comprising inlet and outlet channels connected to the bottom of the working space at both sides of the peripheral point forming the contact point between the disk-shaped rotor and the bottom of the working space, the channels being made substantially as wide as the bottom of the working space.

8. An improved rotary piston machine according to claim 1, in which the annular groove of the working space is limited by an inner and an outer cylindrical wall.

9. An improved rotary piston machine according to claim 8, in which the bottom of the working space is formed in the shape of a truncated cone, so that the tip of the completed cone lies at the point of intersection S of both the axes of rotation of the vanes and the disk-shaped rotor.

10. An improved rotary piston machine according to claim 8, in which the working space tapers toward its bottom, and the inner and outer cylindrical walls are diagonal.

11. An improved rotary piston machine according to claim 10, in which a gap between the vanes and the inner or outer wall of the working space is readjusted by means of an axial shifting of said impeller.

12. An improved rotary piston machine according to claim 11, in which the gap is readjusted by means of a spring-actuated axial shifting of said impeller.

* * * * *